United States Patent [19]
Holt
[11] 4,318,215
[45] Mar. 9, 1982

[54] CONDUCTOR TERMINATING APPARATUS

[75] Inventor: Harley R. Holt, Forest Park, Ill.
[73] Assignee: Bunker Ramo Corporation, Oak Brook, Ill.

[21] Appl. No.: 134,428
[22] Filed: Mar. 27, 1980

Related U.S. Application Data

[60] Continuation of Ser. No. 936,314, Aug. 23, 1978, abandoned, which is a division of Ser. No. 735,955, Oct. 27, 1976, abandoned.

[51] Int. Cl.³ ..... H01R 43/04
[52] U.S. Cl. ..... 29/566.3; 29/749; 29/751; 29/753
[58] Field of Search ..... 29/748–754, 29/566.3, 566.4, 759, 760

[56] References Cited

U.S. PATENT DOCUMENTS 4,038,745 8/1977 Nijman ..... 29/760 X
4,110,896 9/1978 Roiko ..... 29/749 X

*Primary Examiner*—Carl E. Hall
*Attorney, Agent, or Firm*—Nicholas A. Camasto; John R. Hoffman

[57] ABSTRACT

An apparatus for simultaneously terminating a plurality of insulated conductors in the insulation piercing contacts of a multiple contact electrical connector is disclosed. The apparatus includes means for mounting a connector in conductor receiving position, means for aligning the conductors adjacent individual contacts of the connector, means for positioning the insertion tool adjacent the contacts, the insertion tool being movable in a non-arcuate path substantially perpendicular to the planes defined by the contacts of the connector. The apparatus will accommodate connectors of different transverse dimensions without the necessity of any adjustment and includes uniquely configured conductor aligning means which enhance and facilitate the terminating operations.

5 Claims, 15 Drawing Figures

FIG. 4
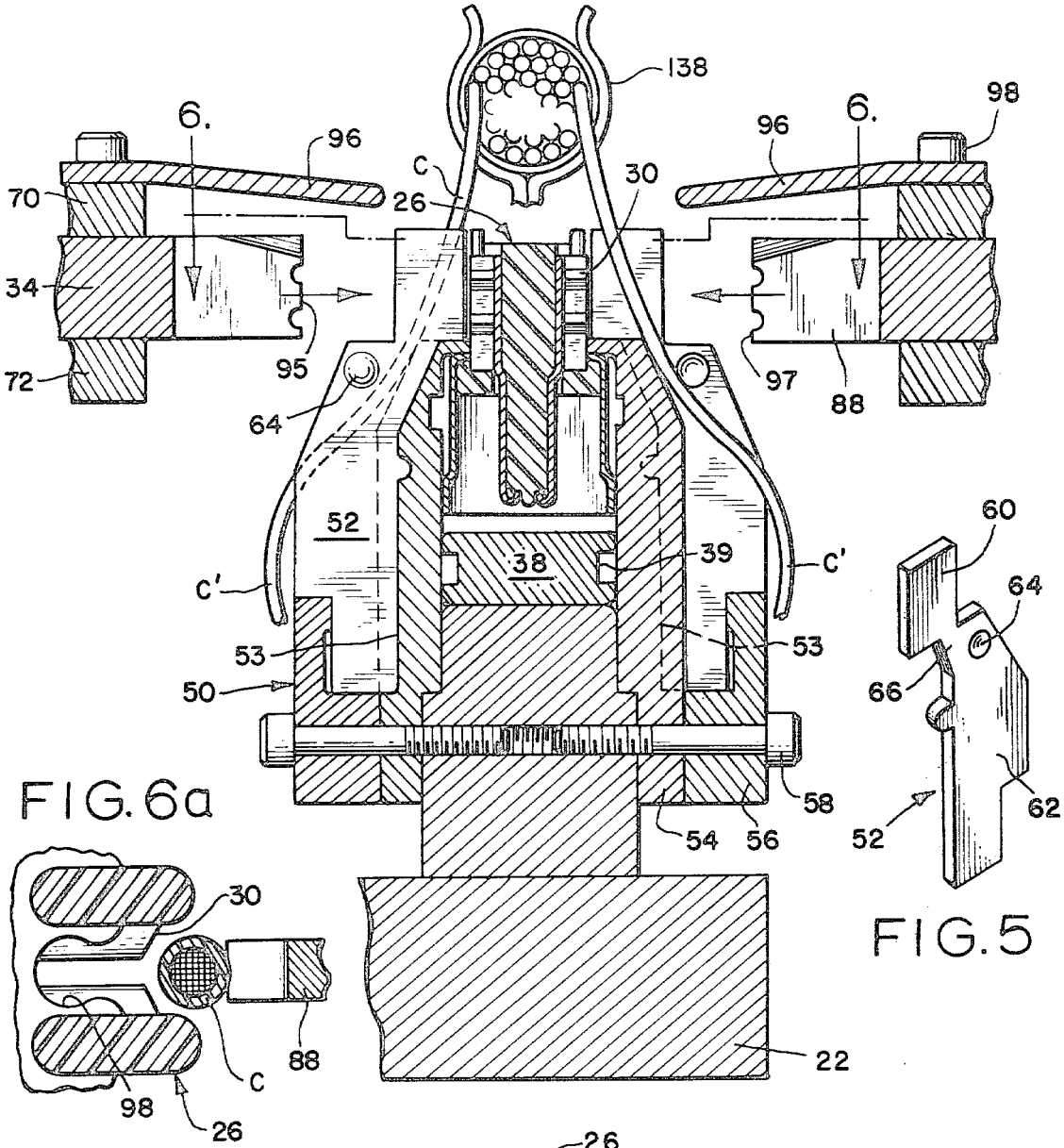
FIG. 6a
FIG. 5
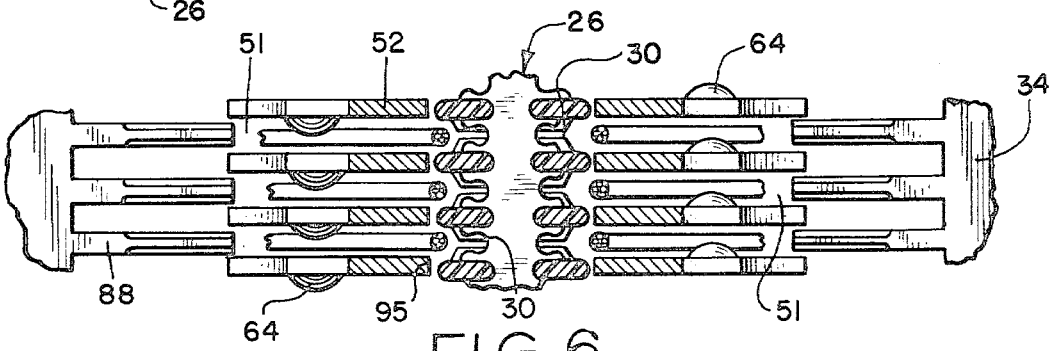
FIG. 6

CONDUCTOR TERMINATING APPARATUS

This is a continuation of application Ser. No. 936,314 filed Aug. 23, 1978, now abandoned, which is a divisional of parent application Ser. No. 735,955 filed Oct. 27, 1976, now abandoned.

BACKGROUND OF THE INVENTION

This invention relates to an apparatus for terminating conductors in electrical connectors and, more particularly, to a device which facilitates and enhances the simultaneous trimming and insertion of insulated conductors in the individual contacts of multiple contact electrical connectors.

With the advent of miniaturized electronics and electrical components, connectors used in the electrical, communication and data handling industries have been reduced in size, making it more difficult to connect the individual conductors with the appropriate electrical terminal of the connector. Accordingly, a wide variety of tools and mechanical devices have been developed in recent years directed at simplifying and expediting the assembly or mounting of conductors in these small electrical connectors. The tools illustrated in U.S. Pat. Nos. 3,742,571, 3,845,535, 3,952,392, 3,965,558 and 3,972,101 are typical examples of the kinds of apparatus developed to meet this need. Generally, these tools provide some mechanism whereby the insulation covered conductor is forced into the conventional insulation piercing terminals of the connector contact.

Prior art termination tools of the type disclosed in U.S. Pat. No. 3,952,392 generally include a frame or support structure having means for holding the connector in conductor receiving position and a pair of oppositely disposed, rotatable arms, each of which includes an insertion tool for engaging and pressing a plurality of insulated conductors into the connector contacts. Such prior art devices are capable, therefore, of simultaneously terminating all of the conductors to be assembled with a given connector by virtue of a very simple sequence of operations.

While these prior art termination tools have met with some success, there are disadvantages associated with their manufacture and use which have limited their acceptance. For example, since the insertion tool, itself, moves through an arc in effecting the termination of the conductors it is not possible to achieve precise uniformity of termination force across the entire row of contacts in the connector. Moreover, in a given line of connectors the dimension between the oppositely facing rows of contacts will be less in the female connector than in the corresponding male connector. Thus, the desired parallel relationship of the insertion tools as the rotatable arms reach the terminating position cannot be achieved for both female and male connectors. To overcome this disadvantage it has been suggested to provide an apparatus wherein the pivot of one of the rotatable arms is movable to accommodate connectors of different widths. This procedure is, however, time consuming and may not be entirely accurate.

A further disadvantage associated with prior art devices is that the means used, if any, to align the conductors with the individual contacts prior to effecting their termination is generally constructed as an integral component. These "comb elements" are not only expensive to manufacture, requiring milling and other machine tool operations, but also difficult to maintain in the field, since individual comb teeth are not replaceable and the shear edge typically disposed in these elements is difficult, if not impossible, to resharpen.

SUMMARY OF THE INVENTION

Accordingly, a primary object of the invention is to provide a new and improved termination apparatus, particularly a field termination apparatus, for the facile termination of a plurality of conductors in the respective contacts of a multiple contact electrical connector.

A more specific object of the invention is to provide a termination apparatus which provides precise and uniform terminating forces to each of the contacts of either a male or female multiple contact connector regardless of dimensional variations across the width of the connectors.

Another object of the invention is to provide a termination apparatus wherein the insertion tool travels along a path substantially perpendicular to the planes defined by the rows of contacts in the connector.

Still another object of the invention is to provide a termination apparatus which includes control means to insure that the insertion tool travels the appropriate distance to effect proper conductor termination in both male and female connectors.

A further object of the invention is to provide a termination apparatus wherein an improved conductor aligning means is employed which not only simplifies and reduces manufacturing costs but also facilitates and improves the terminating operation of the device.

In accordance with the present invention an apparatus is provided which terminates a plurality of insulated conductors with a high degree of precision and uniformity in each of the contacts of a multiple contact electrical connector. The apparatus includes a frame which supports a connector mounting means and conductor aligning means, at least one rotatable arm carrying insertion means, and means for applying an operating force to the insertion means. The connector mounting means, or carriage, is slidably supported on the frame from an initial position to a conductor receiving position. The conductor aligning means is fixedly secured to the frame and comprises comb elements having a plurality of uniquely configured teeth assembled in spaced relationship and adapted to capture the free ends of the individual conductors in the appropriate terminating position adjacent the respective contacts. The arm is rotatably mounted on the frame and is adapted for arcuate movement toward opposite sides of the connector into positions immediately adjacent the connector contacts. The insertion means carried by the arm includes a multi-blade insertion member, each of the blades adapted to engage and press a single conductor into a respective contact of the connector. The force application means comprises a camming element operable to translate forces developed by a rotatable lever into a horizontal force which is transmitted through the insertion member to the individual conductors.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings, in which:

FIG. 4 is a cross-sectional view of the entire apparatus taken along line 4—4 of FIG. 3 and showing the alignment of the insulated conductors adjacent the contacts of a male connector with the arms and their respective insertion members in a partially open position;

FIG. 5 is a perspective view of a preferred comb tooth utilized in the unique conductor aligning means of the present invention;

FIG. 6 is a cross-sectional view along line 6—6 of FIG. 4, illustrating in greater detail the inter-relationship of the connector, the conductors, the conductor aligning means and the blades of insertion members;

FIG. 6*a* is an enlarged partial cross-sectional view illustrating the contact structure in greater detail and its relationship to the conductor and insertion blade;

DETAILED DESCRIPTION OF THE INVENTION

Figure 1:
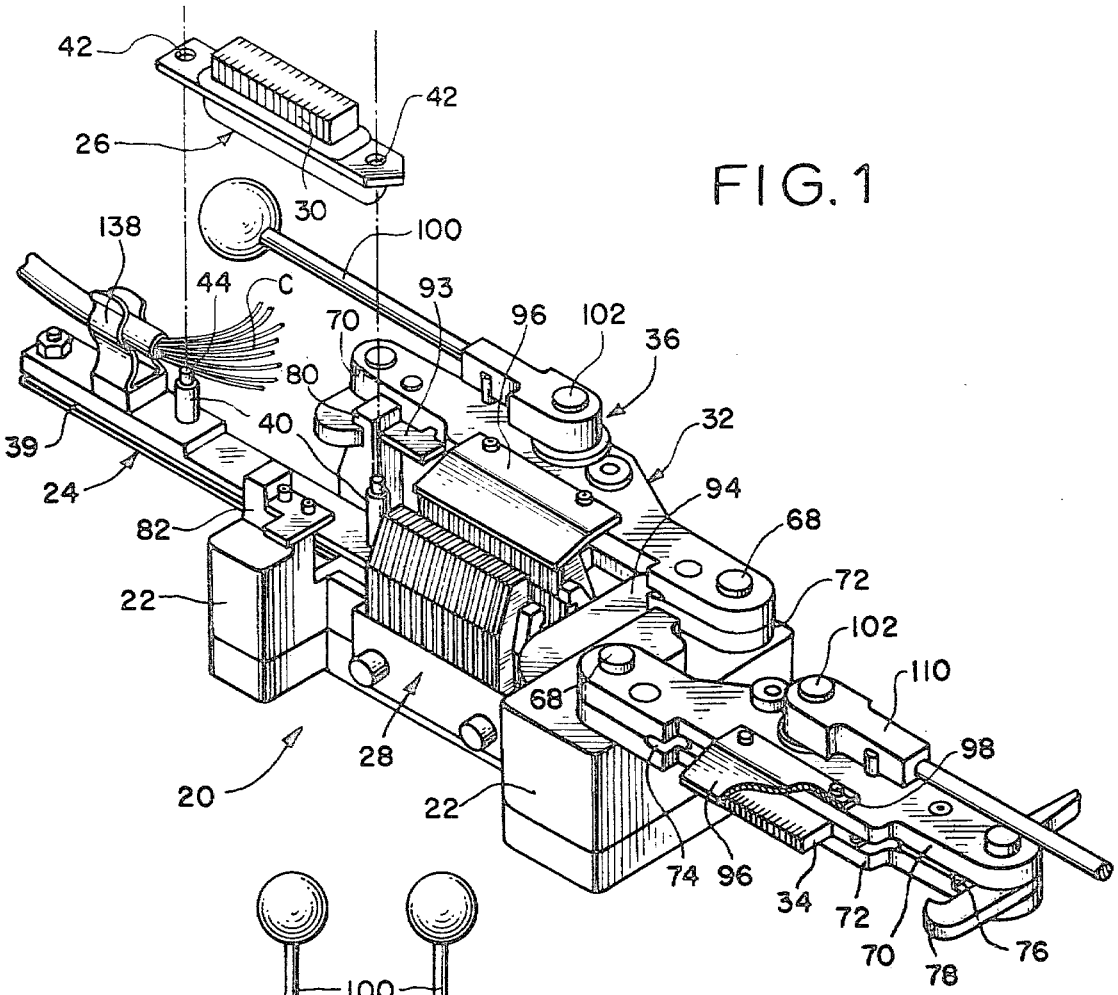
FIG. 1 is a perspective view illustrating one preferred embodiment of the invention with two rotatable arms, one in the open position and the other rotatable arm in the closed, termination position.

Referring to FIG. 1, a preferred apparatus of the present invention, designated generally as 20, is shown to comprise a frame 22, a carriage 24 supported on the frame and adapted to mount a connector 26 in conductor receiving position, means 28 for aligning the conductors with respective contacts 30 of the connector, a pair of arms 32 used to position the insertion members 34 adjacent the rows of contacts 30, and a camming mechanism 36 used to transmit the appropriate termination force to the individual conductors.

Figure 2:
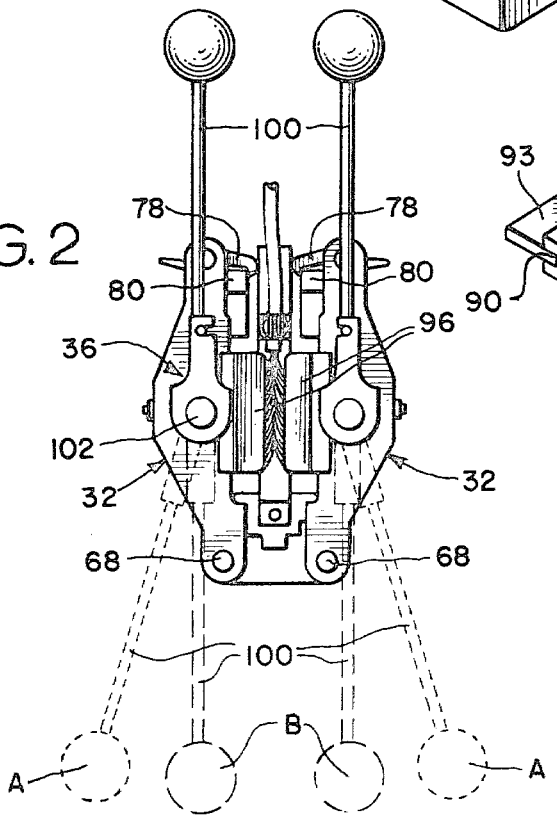
FIG. 2 is a plan view of the embodiment of FIG. 1 illustrating, in solid lines, both rotatable arms in the closed position with the camming levers in the initial operating position and, in dotted lines, the camming levers at subsequent operating positions.
Figure 1A:
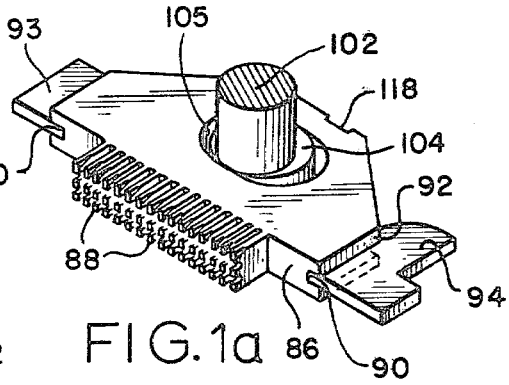
FIG. 1*a* is an enlarged perspective view illustrating in greater detail the insertion member employed in the embodiment of FIG. 1 and showing its relationship with the camming element which applies to the termination member the appropriate termination force.

The carriage 24 is the means by which the connector 26 is mounted within the apparatus 20 in the conductor receiving position. The carriage includes a base plate 38 and suitable locating means which cooperate with the connector to insure its proper location. In the illustrated embodiment the base plate 38 includes a pair of longitudinal slots 39 which cooperate with rails 41 mounted on the frame 22 (see FIG. 3*a*), thereby enabling the carriage 24 to slide from an initial open position shown in FIG. 1 to a final conductor receiving position shown in FIG. 2. Locating pins 40 are amployed to engage apertures 42 in the opposite ends of the connector 26. Each of the pins 40 includes a shoulder 44 on which the connector 26 rides. Thus, the illustrated locating means insures the proper lateral and vertical placement of the connector 26. As can be clearly seen in FIG. 3*b*, the carriage 24 also includes a spring biased pin 46 which cooperates with an adjustable detent 48 to locate the connector longitudinally as well. The detent 48 is threaded into the frame 22 to allow precise alignment of the connector with the conductor aligning means 28 and the insertion members 34.

The conductor aligning means 28 comprises a pair of comb elements 50 each including a plurality of uniquely configured comb teeth 52. The comb teeth define a plurality of conductor receiving slots 51 which are alignable with the contacts 30 of the connector 26. As shown in FIG. 4, the comb teeth 52 are disposed in machined slots 53 formed in an inside member 54 of the comb element and securely clamped into position by an outside member 56 and bolts 58. The bolts 58 also serve to fixedly secure the comb elements 50 to the base 22.

FIG. 5 illustrates the unique configuration of the comb tooth 52 used in the preferred embodiment of the present invention. It will be noted that tooth 52 has an upstanding head portion 60 and an elongated body 62 which serve as guides through which the conductors C are easily threaded. In addition, the tooth 52 includes a dimple or small protuberance 64 adjacent the neck 66 which joins the head portion 60 with the body 62. As can be seen in FIGS. 5 and 6, the conductors C are threaded into the slots 51 and are snapped past the dimples 64 of the comb teeth 62 so that they are captured in appropriate alignment with the contacts 30 of the connector. It should be noted that while the comb teeth 52 with their respective dimples 64 tend to align the conductors C, they do not apply a clamping or holding force to the free ends C′ of the conductors. This arrangement not only facilitates removal of these ends after the termination procedure has been completed, but it also eliminates the development of tension on the conductor immediately prior to and during the trimming operation. This, in turn, lessens the possibility of trimming the conductors to an improper length.

Figures 3, 3A, 3B, 3C:
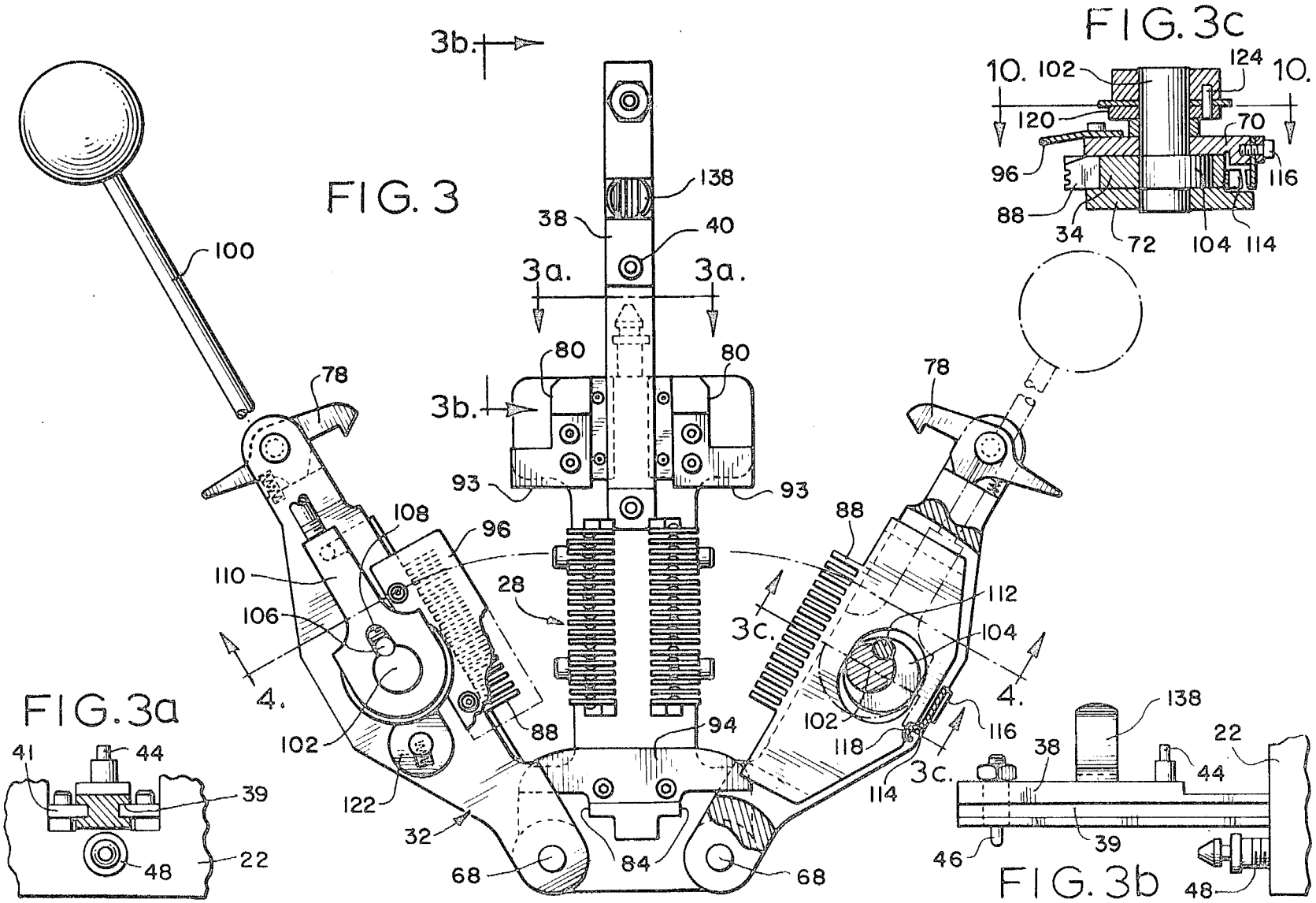
FIG. 3 is a plan view of the embodiment of FIG. 1 showing both arms in the open position and, in partial cross-section, the structural arrangement of the rotatable arm, insertion member and camming element.
FIG. 3*a* is an enlarged cross-sectional view taken along line 3*a*—3*a* of FIG. 3.
FIG. 3*b* is a side elevation taken along line 3*b*—3*b* of FIG. 3 and showing the carriage and detent structure of the apparatus.
FIG. 3*c* is a cross-sectional view taken along line 3*c*—3*c* of FIG. 3.

As can be seen in FIGS. 3 and 6, the dimples 64 on the respective comb elements 50 face in opposite directions. This results from the fact that comb teeth 52 on each of the comb elements 50 are identical in every respect as are the inside and outside members, 54 and 56. Thus, the comb elements 50 are merely mounted in reverse disposition to one another on frame 22.

The arms 32, rotatably mounted to the frame 22 by pins 68, are composed of upper and lower plates 70 and 72, respectively, which are configured to provide an intermediate arm slot 74 and an end arm slot 76. The intermediate slot 74 houses the insertion member 34 while the end slot 76 accommodates a pivotal and spring biased latch 78. As the arms 68 are rotated to the closed position their respective latches 78 engage the latch surfaces 80 to secure the arms in the closed, termination position adjacent the rows of contacts on the connector 26 in preparation for the termination operation. Guide surfaces 82 and 84 on the frame 22 serve as stops which abut the inside surfaces of the arms 32 to insure the precise location of the arms immediately adjacent the oppositely facing rows of contacts 30 on the connector.

Figure 7:
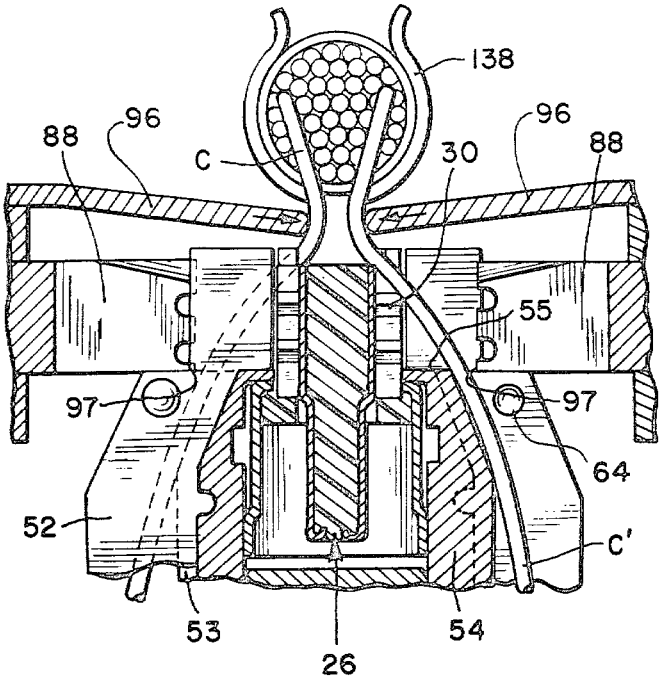
FIG. 7 is a cross-sectional view similar to that of FIG. 4 illustrating the arms in the closed, insertion position with the blades of the insertion members located at their respective positions immediately prior to the conductor trimming operation.
Figure 9:
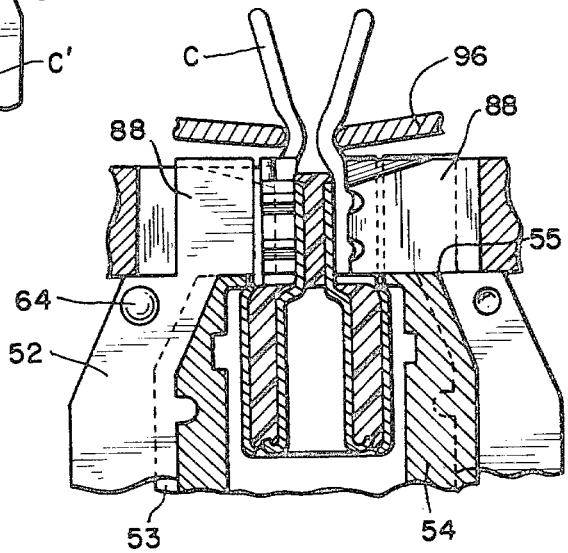
FIG. 9 is a cross-sectional view identical to FIG. 8 illustrating the termination of the conductors in the contacts of a female connector.
Figure 8:
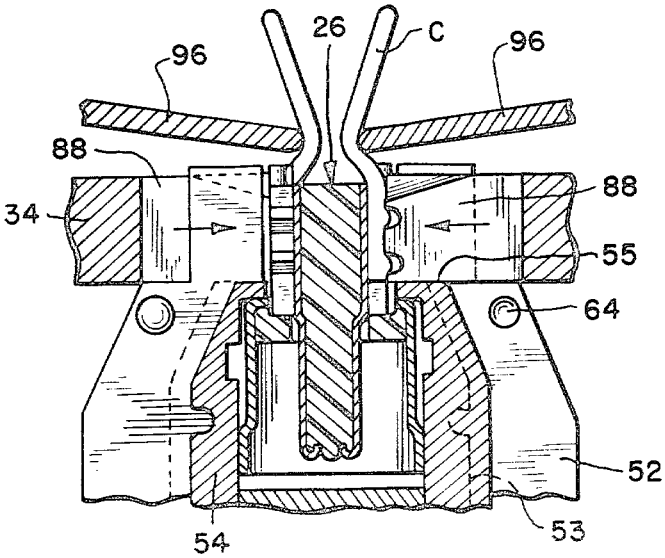
FIG. 8 is also a cross-sectional view similar to that of FIG. 4 illustrating the blades of the insertion members in final position having effected the termination of the conductors in the contacts of a male connector.

Each of the insertion members 34 includes a front face 86 having a series of insertion blades 88 extending outwardly therefrom. The member 34 also includes a pair of recesses 90 along the side faces 92 which mate with guide plates 93 and 94 as the arms 32 rotate toward their closed position. The cooperation of the recesses 90 and plates 93 and 94 insures the precise alignment of the members 34 even though, as described below, these members 34 are substantially free floating within the arms 32. The insertion blades are configured along their engaging leading edge 95, in a manner well known in the art, to properly engage the specific dimensions and the geometric configuration of the contacts 30. In addition, the insertion blades 88 include a bottom shearing edge 97 which coacts with a stationary shear surface 55 formed in the inside members 54 of the comb elements 50. As is clearly seen in FIGS. 7–9, the shear edge 97 and shear surface 55 act to trim the conductor C immediately prior to the insertion operation.

Each of the arms 32 also includes a clamp bar 96 which may be formed integral with the upper arm 70 or mounted to the upper arm by bolts 98 or other suitable fastening means. The clamp bars 96 extend outwardly from the upper surface of the arms 32 (see FIG. 4) to a point beyond the engaging edges 95 of the insertion blades 88. As is illustrated in FIGS. 2 and 7–9, the clamp bars 96 engage the conductors C when the arms 32 reach their closed position and urge the conductors into the strain relief mechanism 98 (shown in FIG. 6*a*) of the connector. This arrangement assures that even after the conductors have been trimmed and during the insertion operation, they will not be longitudinally displaced with respect to the contact 30. Of course, such a feature is highly desirable in that the possibility of a defective connection between the conductor C and the contact 30 is reduced.

In accordance with an important feature of the present invention, the insertion members 34 are driven by camming elements 36 along a path substantially perpendicular to the contact planes defined by the rows of contacts 30 in the connector. Each camming element 36 is operatively associated with an arm 32 and includes a lever 100, a rotatable shaft 102, a cam member 104, and a cam following slot 105. A key pin 106 prevents relative rotation between the lever 100 and the shaft 102, the key being secured by the inside end 108 of the lever 100 which is threaded into the lever base 110. The eccentric cam member 104 is formed integrally with shaft 102 or may be keyed thereto by key pin 112. As is clearly seen the shaft 102 is journaled in both the upper and lower plates 70 and 72, respectively. The cam following slot 105 is formed in the insertion member 34 which slides freely within the intermediate arm slot 74. A small leaf spring 114 is mounted from a support 116 which depends from the upper arm plate 70, the spring engaging a small notch 118 to prevent insertion member 34 from floating in slot 74 to such an extent as to impede the proper engagement of recesses 90 and guide plates 93 and 94.

It will be apparent from the foregoing that as the lever 100 is rotated the shaft 102 and cam member 104 will also rotate thereby effecting a horizontal displacement of the insertion member 34 along guide plates 94. Moreover, when this operation is conducted with the arms 32 in the closed position, the members 32 will travel along a path substantially perpendicular to the planes defined by the rows of contacts 30.

Figure 10:
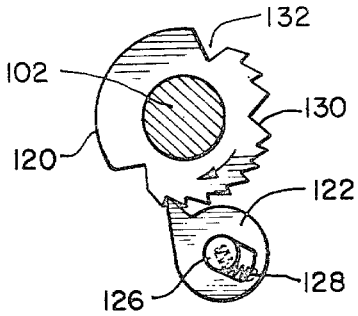
FIG. 10 is a cross-sectional view taken along line 10—10 of FIG. 3*c* illustrating in greater detail the ratchet arrangement employed with the camming elements of the present invention.

In order to insure that the insertion member 34 travels the required distance in terminating the conductors in the connector, each camming element 36 may also include a ratchet 120 and pawl 122 which coact to require full operative rotation of the levers 100. The ratchet 120 is mounted to the underside of the lever base 110 and secured to prevent relative rotation by key pin 124. The pawl 122 is mounted on shaft 126 and is biased toward the ratchet 120 by a small compression spring 128. As is clearly illustrated in FIG. 10, the ratchet 120 includes two release recesses 130 and 132, respectively, which allow the pawl to release from the ratchet in a manner well known in the art. The necessity for two release positions arises from the fact that connectors of different dimensions (i.e., male and female connectors) may be used with the present invention. Thus, a male connector, having a greater transverse dimension, requires less travel of insertion member 34 for proper termination than does a female connector. This difference in insertion member movement is accommodated by the recesses 130 and 132. When connecting conductors to a male connector, the levers 100 are rotated from the initial position (FIG. 2, solid lines) to position A (FIG. 2, dotted lines) whereupon the operator will feel the ratchet release. The levers 100 may then be returned to the initial position. When a female connector is employed, the levers 100 will be rotated further to position B (FIG. 2, dotted lines) whereupon the operator will again feel the ratchet release. In this manner the present invention will automatically accommodate either a male or female connector without any adjustment of the force transmitting components of the apparatus.

In the operation of the preferred embodiment, a connector 26 is mounted on pins 40 of the carriage 24 and a cable or bundle of conductors C are secured, such as by spring clamp 138, adjacent the connector. The carriage is then moved to the conductor receiving position, and each of the conductors C is threaded through the appropriate slot 51 and snapped passed the dimple 64 into alignment with an individual contact 30. Next, the arms 32 are rotated to the closed position whereupon the latches 78 lock into position. The levers 100 are then rotated to either position A or B (FIG. 2) depending on whether a male or female connector is being assembled. The levers may then be returned to their initial position retracting the blades 88 from the contacts 30 of the connector. In this manner the conductors C may be expeditiously trimmed and inserted in each of the contacts 30.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. In an apparatus for terminating a plurality of insulated conductors in the contacts of an electrical connector having means for mounting said connector in conductor receiving position, means for aligning said conductors adjacent said contacts, insertion means for engaging and pressing said conductors into said contacts and means for applying an operating force to said insertion means, the improvement comprising:

said conductor aligning means including a comb element having a plurality of comb teeth defining a series of closed conductor receiving slots, each said slot being defined by a slot bottom, opposing faces of adjacent comb teeth, and protruding means, spaced from said slot bottom, for blocking exit from said slot to confine a conductor in said slot without directly applying a holding force thereto.

2. The improved termination apparatus of claim 1 wherein said protruding means comprises protuberances on said comb teeth, said protuberance extending into said conductor receiving slots adjacent said comb teeth.

3. The improved termination apparatus of claim 1 wherein said conductor receiving slots have head portions and neck portions and said protruding means includes protuberances on said comb teeth, said protuberances being positioned adjacent said neck portions and spaced from said head portions, said protuberances extending into said conductor receiving slots adjacent said comb teeth.

4. The improved termination apparatus of claim 3 further including shear means associated with each said slot for trimming said conductors confined in said slots immediately prior to insertion of said confined conductors into the contacts of the connector, said protuberances being positioned on said comb teeth toward the free end of said confined conductors relative to said shear means.

5. The improved termination apparatus of claim 1 wherein said comb teeth are releasably mounted in said comb element.

* * * * *